US011446557B2

(12) United States Patent
Whitney et al.

(10) Patent No.: US 11,446,557 B2
(45) Date of Patent: Sep. 20, 2022

(54) LACROSSE HEAD SPACER

(71) Applicant: East Coast Dyes, Inc., Towson, MD (US)

(72) Inventors: Hamilton Sean Michael Whitney, Baltimore, MD (US); Gregory Kenneally, Lutherville, MD (US); Brian Schaaf, West Chester, PA (US); Michael Kenneally, Lutherville, MD (US)

(73) Assignee: EAST COAST DYES, INC., Towson, MD (US)

( * ) Notice: Subject to any disclaimer, the term of this patent is extended or adjusted under 35 U.S.C. 154(b) by 0 days.

(21) Appl. No.: 16/279,932

(22) Filed: Feb. 19, 2019

(65) Prior Publication Data

US 2020/0261780 A1 Aug. 20, 2020

(51) Int. Cl.

*A63B 60/42* (2015.01)
*A63B 59/20* (2015.01)
*A63B 102/14* (2015.01)

(52) U.S. Cl.

CPC ..... *A63B 60/42* (2015.10); *A63B 59/20* (2015.10); *A63B 2102/14* (2015.10)

(58) Field of Classification Search

CPC ..... A63B 59/10; A63B 60/42; A63B 60/44; A63B 60/56; A63B 59/20
USPC ..... 473/513; 248/176.1, 346.03, 346.04, 248/346.5
See application file for complete search history.

(56) References Cited

U.S. PATENT DOCUMENTS

| | | | | |
|---|---|---|---|---|
| 3,473,247 | A | 10/1969 | La Favor et al. | |
| 5,899,167 | A | 5/1999 | Furman | |
| 6,152,839 | A * | 11/2000 | Heyduk | A63B 59/70 473/562 |
| 6,170,185 | B1 | 1/2001 | Donofrio | |
| 6,926,627 | B1 * | 8/2005 | LeMire | A63B 60/42 473/513 |
| 7,972,228 | B1 * | 7/2011 | Dikmanis | A63B 59/20 473/513 |
| 8,283,045 | B2 | 10/2012 | Stoelting | |
| 8,291,852 | B1 | 10/2012 | Cameron et al. | |

(Continued)

OTHER PUBLICATIONS

UnPincher by Maryland Tree LAX, www.instagram.com/therealmarylandtreelax and sidelineswap.com/gear/lacrosse/sticks/heads/667866-unpincher, posted Jan. 30, 2019 (Year: 2019).*

(Continued)

*Primary Examiner* — Laura Davison
(74) *Attorney, Agent, or Firm* — Medler Ferro Woodhouse & Mills PLLC

(57) ABSTRACT

A lacrosse head spacer includes a front surface, left and right side surfaces attached at a left and right edges of the front surface, and a curved back surface extending between the left and right side surfaces. A width of the lacrosse head spacer measured perpendicularly from the left side surface to the right side surface is larger than a minimum width dimension specified by NCAA rules for lacrosse heads such that when the lacrosse head spacer is inserted between sidewalls of a lacrosse head, the lacrosse head spacer maintains the sidewalls apart from each other at a distance larger than the minimum width dimension specified by NCAA rules for lacrosse heads.

28 Claims, 13 Drawing Sheets

(56) References Cited

U.S. PATENT DOCUMENTS

2014/0158841 A1 6/2014 Mooney

OTHER PUBLICATIONS

YouTube Video titled "ECD Mirage Lacrosse Head", published by RedStarLacrosse on Oct. 26, 2016 (Year: 2016).*
Martin Body & Fender Tools catalog, "Heel Dolly", p. 7, copyright 2016 (full catalog available online at www.purvisindustries.com/ASSETS/DOCUMENTS/ITEMS/EN/Martin_HH105106FG_Catalog.pdf) (Year: 2016).*
Inside Lacrosse, "Widening a Head", forums.insidelacrosse.com/threads/widening-a-head.5869, Jun. 2004; "Un-pinch", forums.insidelacrosse.com/threads/un-pinch.147871, Apr. 2009; and "How to UN pinch your head", forums.insidelacrosse.com/threads/how-to-un-pinch-your-head.180609, Mar. 2010 (Year: 2010).*

* cited by examiner

LACROSSE HEAD SPACER

FIELD OF THE INVENTION

The invention relates generally to an accessory for a lacrosse head, and more particularly to a spacer for maintaining proper dimensions of a lacrosse head.

BACKGROUND OF THE INVENTION

In a game of lacrosse, lacrosse heads may become misshapen or distorted due to use. In particular, during a face-off, two opposing players face each other in the middle of the field, with the lacrosse ball placed on the ground on the center line between the heads of their sticks. Players facing off must rest their stick in their gloved hands on the ground and position themselves entirely behind the heads of their sticks. When the face-off commences, the players compete for possession of the lacrosse ball, often by trying to clamp the lacrosse ball under the backside of their lacrosse head and passing or directing the lacrosse ball to their teammates. To clamp the lacrosse ball, a player will rotate or turn his lacrosse stick to a position in which the backside of the lacrosse head covers the lacrosse ball with both of the opposing sidewalls of the lacrosse head adjacent or in close proximity to the ground. This action often distorts the heads due to the pressure applied by the player. However, the rules of lacrosse specify dimensions of the lacrosse head at various locations of the lacrosse head. For example, current NCAA (college) and NFHS (high school) lacrosse regulations specify that a lacrosse head must be at least 3 inches wide at 1.25 inches and 3 inches from the throat (front and back of the head), must be at least 3.5 to 4.0 inches wide (front) and at least 3.5 inches wide (back) at 5 inches from the throat, must be at least 6 inches wide at the widest part of the head (normally near the scoop), and must be at least 10 inches in length from the throat to the end of the scoop. FIG. 18 shows an illustration of a lacrosse head with the current regulations regarding dimensions.

Lacrosse sticks of players, including lacrosse heads, may be randomly tested during a game to ensure that the lacrosse sticks comply with the regulations. A lacrosse head that is not in compliance with the regulations results in a penalty for the team of the player whose lacrosse head was out of compliance. Due to the pressures and twisting applied to lacrosse heads during a game, particularly during face-offs, a lacrosse head that initially complied with the regulations regarding dimensions may fall out of compliance with the regulations. Accordingly, there is a need for a device that a player can use to ensure that the lacrosse head stays in compliance with dimensional regulations of a lacrosse head.

BRIEF SUMMARY OF THE INVENTION

Embodiments hereof are directed to a lacrosse head spacer. In some embodiments, the lacrosse head spacer includes a flat front surface, a left side surface attached at a left edge of the flat front surface, a right side surface attached at right edge of the flat front surface, and a curved back surface extending between the left side surface and the right side surface, wherein the curved back surface is disposed opposite the flat front surface. The width of the lacrosse head spacer measured perpendicularly from the left side surface to the right side surface is configured such that when the lacrosse head spacer is inserted between sidewalls of a lacrosse head, the lacrosse head spacer maintains the sidewalls apart from each other at a distance larger than the minimum width dimension specified by NCAA rules for lacrosse.

Embodiments hereof are also directed to a lacrosse head spacer including a first flat surface, a second surface and a third surface attached at opposing first and second edges of the first flat surface, and a curved surface extending between the second surface and the third surface, wherein the curved surface is disposed opposite the first flat surface. The first flat surface, the second surface, the third surface, and the curved surface are arranged in a generally cubic shape. The width of the lacrosse head spacer measured perpendicularly from the second surface to the third surface is in a range of about 3.005 to about 4.25 inches, and the lacrosse head spacer is configured to maintain sidewalls of a lacrosse head spaced apart a distance in a range of about 3.005 inches to about 4.25 inches when the lacrosse head spacer is inserted between the sidewalls of the lacrosse head. In some embodiments, the width of the lacrosse head spacer is in the range of about 3.125 inches to about 3.875 inches, or in the range of about 3.375 inches to about 3.75 inches.

Embodiments hereof are also directed to a lacrosse head spacer embodiments including a flat front surface, a left side surface attached at a left edge of the flat front surface, a right side surface attached at right edge of the flat front surface, a curved back surface extending between the left side surface and the right side surface, wherein the curved back surface is disposed opposite the flat front surface. The width of the lacrosse head spacer measured perpendicularly from the left side surface to the right side surface is configured wherein a width of the lacrosse head spacer measured perpendicularly from the left side surface to the right side surface is in a range of about 1% to about 40% larger than a minimum width dimension specified by NCAA rules for lacrosse heads, and the lacrosse head spacer is configured to maintain sidewalls of a lacrosse head spaced apart a distance in a range of about 1% to about 40% larger than the minimum width dimension specified by NCAA rules for lacrosse heads when the lacrosse head spacer is inserted between the sidewalls of the lacrosse head. In some embodiments, the width of the lacrosse head spacer is in the range of about 4% to about 30% larger than the minimum width dimension specified, or in the range of about 12% to about 35% larger than the minimum width dimension specified.

Embodiments hereof are also directed to a lacrosse head spacer including a flat front surface, a left side surface attached at a left edge of the flat front surface, a right side surface attached at right edge of the flat front surface, a flat back surface, a first angled surface extending between the left side surface and the flat back surface, and a second angled surface extending between the right side surface and the flat back surface, wherein the first and second angled surfaces are angled such that a back width of the flat back surface measured from where the first angled surface meets back surface to where the second angled surface meets the back surface is less than a side width measured perpendicularly from the left side surface to the right side surface. The side width of the lacrosse head spacer is configured such that when the lacrosse head spacer is inserted between sidewalls of a lacrosse head, the lacrosse head spacer maintains the sidewalls apart from each other at a distance larger than the minimum width dimension specified by NCAA rules for lacrosse. In some embodiments, the side width is in the range of about 3.005 inches to about 4.25 inches, or in the range of about 3.125 inches to about 3.875 inches, or in the range of about 3.375 inches to 3.375 inches.

BRIEF DESCRIPTION OF DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION OF THE INVENTION

Figure 1:
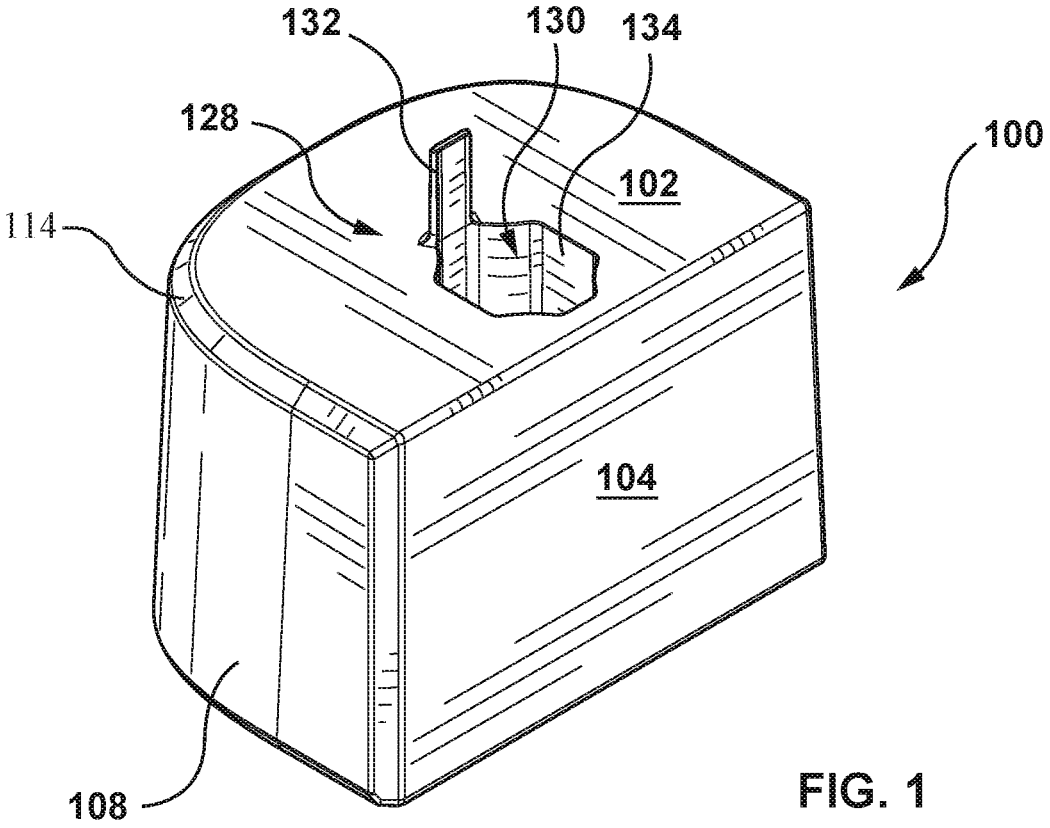
FIG. 1 is a front, left perspective view of a lacrosse head spacer according to an embodiment hereof.
Figure 2:
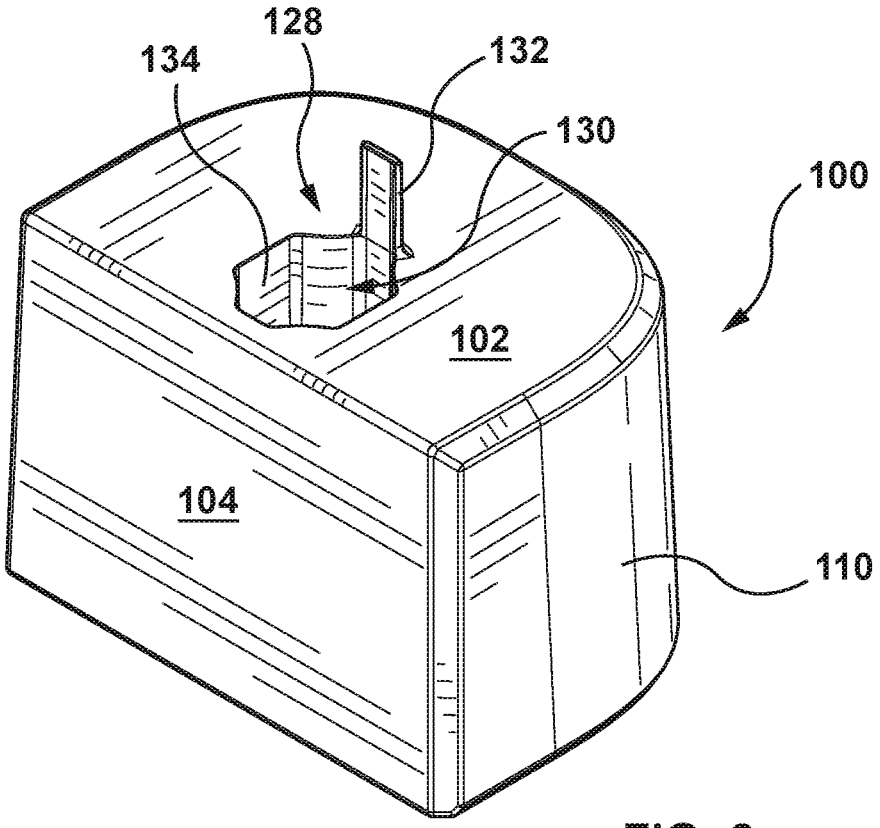
FIG. 2 is a front, right perspective view of a lacrosse head spacer of FIG. 1.
Figure 3:
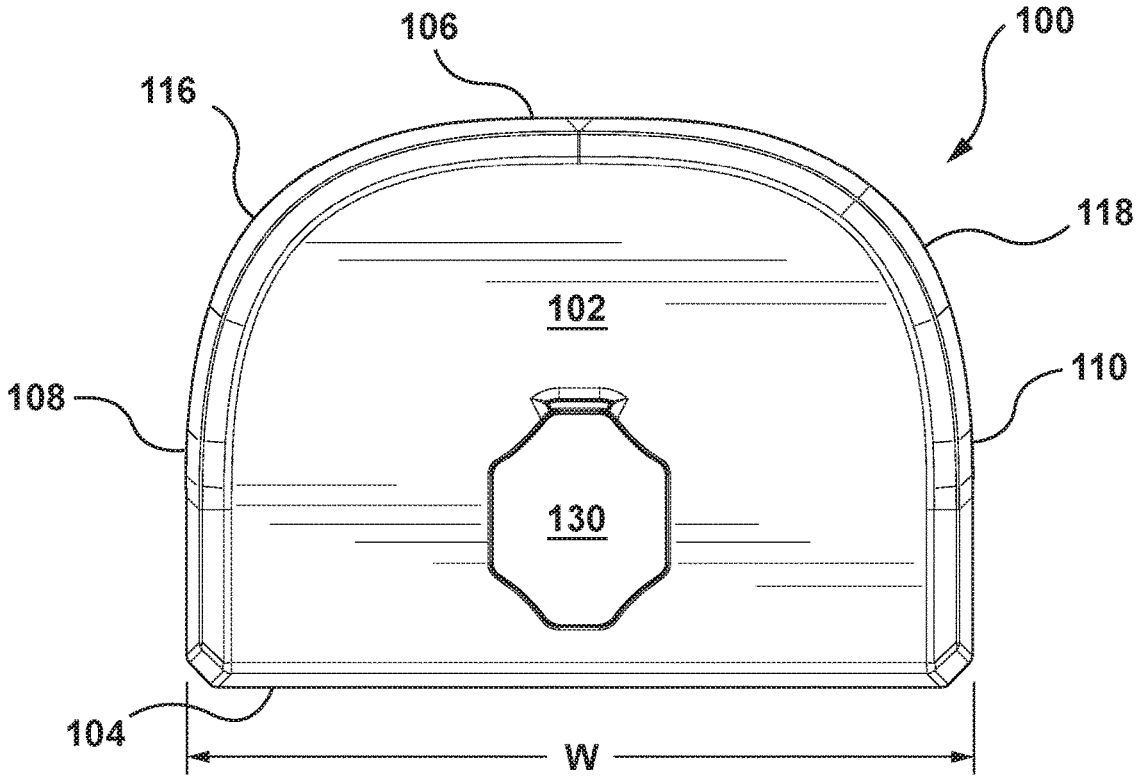
FIG. 3 is top view of the lacrosse head spacer of FIG. 1.

Specific embodiments of the present invention are now described with reference to the figures, wherein like reference numbers indicate identical or functionally similar elements. The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Embodiments hereof relate to a lacrosse head spacer configured such that when inserted between sidewalls of a lacrosse head, the lacrosse head spacer maintains the sidewalls sufficiently apart from each other such that when the lacrosse head spacer is removed, the sidewalls are sufficiently apart from each other so as to meet regulations. In some embodiments, the lacrosse head spacer may also be used as a display device.

With reference to FIGS. 1-9, a lacrosse head spacer 100 has a generally cubic structure with a curved surface for inserting between sidewalls of a lacrosse head, as explained in more detail below. The term "generally cubic" as used herein does not require right angles between each surface described below. The lacrosse head spacer 100 include a top surface 102, a front surface 104, a back surface 106, a left side surface 108, a right side surface 110, and an open bottom 112. Although the bottom 112 is shown as an open bottom, it instead may be closed such that the bottom is a bottom surface. It is understood that the terms "top", "bottom", "front", "back", "left", and "right" are relative and depend on the orientation of the of the lacrosse head spacer 100, and therefore are not limiting. Thus, the terms are interchangeable and other terms such as "first", "second" "third", "fourth", etc. instead may be used to describe the surfaces. In this particular embodiment, the front surface 104 is labeled as a front surface because, as will be described in more detail below, the front surface 104 may be used for advertising at the point of sale of lacrosse head sold in combination with a lacrosse head spacer described herein. Similarly, as described in further detail below, the top surface 102 is labeled as a top because it may be used to secure the lacrosse head spacer 100 to a lacrosse head for display at the point of sale, wherein the lacrosse head hangs from a hook or the lacrosse head spacer 100 sits on a surface such that the top surface 102 would be located vertically above the open bottom 112.

As shown the top surface 102 is attached at respective sides thereof to the left side surface 108, the right side surface 110, the front surface 104, and the back surface 106. Similarly, the front surface 104, back surface 106, left side surface 108, and right side surface 110 are attached at their respective top edges to the top surface 102 and their respective bottom edges form the open bottom 112. If the open bottom 112 were instead a surface, the bottom edges of the front, back, and side surfaces 104, 106, 108, 110 would be attached to respective side edges of the bottom surface. Further, the front surface 104, back surface 106, left side surface 108, and right side surface 110 are attached at their respect side edges to the adjacent surface. For example, the front surface 102 is attached at its left and right side edges to the left and right side surfaces 108, 110, respectively. In some embodiments, the attachment between the top surface 102 and each of the front, back, and side surfaces 104, 106, 108, 110 may include chamfered edges 118. In some embodiments, the chamfered edges 114 may be at an angle of approximately 45 degrees. In other embodiments, the chamfered edges 114 may be at an angle in the range of 5 to 85 degrees. In other embodiments, the attachment edges need not be chamfered.

In the embodiment shown in FIGS. 1-8, the attachment between the left side surface 108 and the back surface 106 is curved, as indicated at curve 116 and the attachment between the right side surface 110 and the back surface is also curved, as indicated at curve 118. The back surface 106 is also curved. As would be understood by those skilled in the art, the curve 116 is part of the left side surface 108 and the back surface 106, and the curve 118 is part of the right side surface 110 and the back surface 106. In an embodiment, the radius of curvature of the curves 118 and 116 is 1.75 inches. However, the present invention is not limited to a radius of curvature of 1.75 inches. A radius of curvature that permits a smooth insertion of the lacrosse head spacer 100 between the sidewalls of a lacrosse head is desirable. As explained in more detail below, the curves 116, 118 enable the lacrosse head spacer 100 to be easily inserted between sidewalls of a lacrosse head so as to ensure that when the lacrosse head spacer is removed, the lacrosse head is in compliance with regulations for lacrosse head dimensions, particularly width dimensions.

Figure 9:
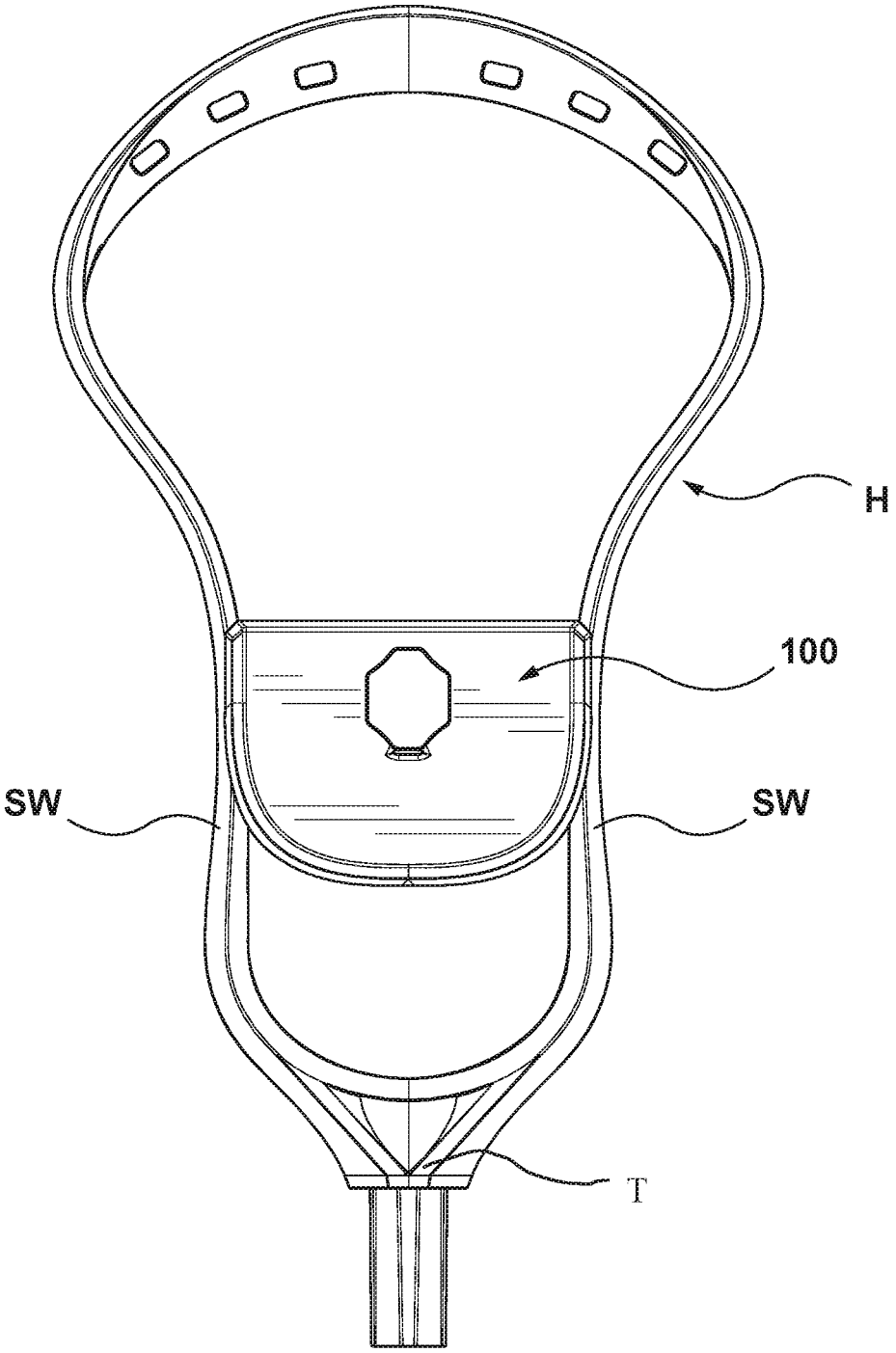
FIG. 9 is an illustration of lacrosse head spacer of FIG. 1 inserted between sidewalls of a lacrosse head to ensure compliance with dimensional regulations of the lacrosse head.

As explained briefly above, governing bodies for lacrosse leagues prescribe certain limitations on dimensions for lacrosse heads, and lacrosse heads may fall out of compliance with these dimensions as a result of normal play, particularly during face-offs. The lacrosse head spacer 100 of the present application may be used when a player is on the sidelines to maintain the player's lacrosse head in compliance. In particular, players who face-off often run off the field of play after the face-off and do not participate in play other than the face-off. If such a player does participate in other play, it may be with a different stick. Further, lacrosse players substitute regularly during a game such that a player may use the lacrosse head spacer 100 of the present invention while on the sidelines. Thus, when on the sideline during a game, a player may place the lacrosse head spacer 100 of the present application between sidewalls SW of a lacrosse head H, as shown in FIG. 9.

Figure 14:
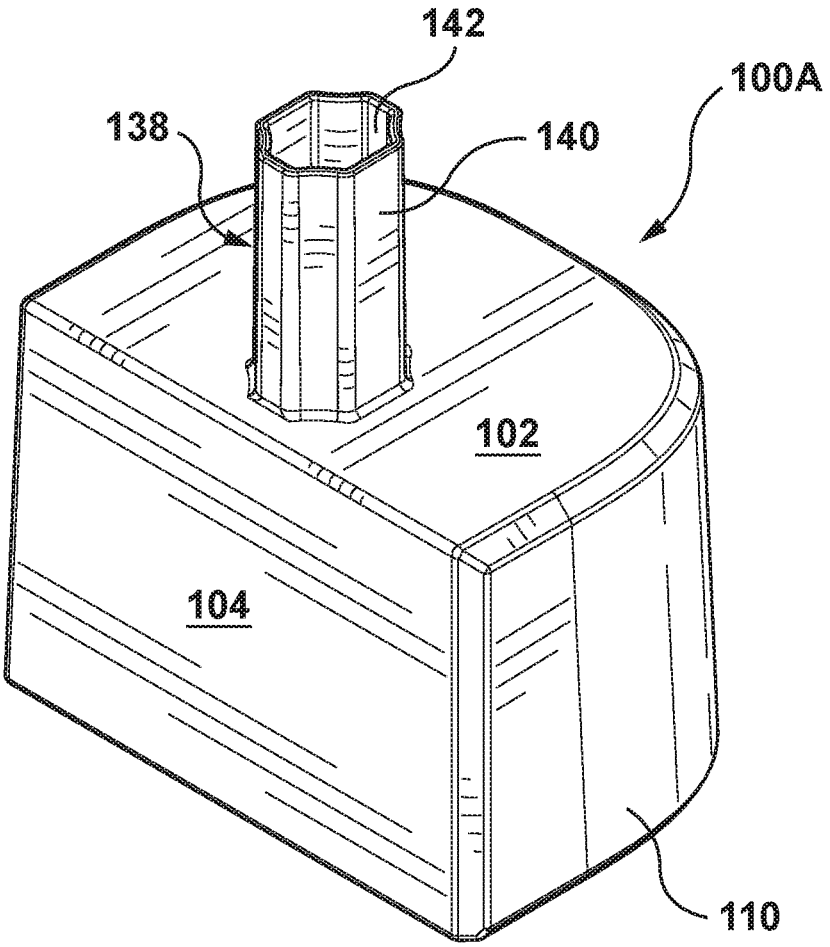
FIG. 14 is a perspective view of a lacrosse head spacer in accordance with another embodiment hereof.

The most likely regulated dimension to fall out of compliance is the width requirement of at least 3 inches wide at 1.25 inches and 3 inches from the throat (front and back of the head) (see FIG. 14). Therefore, when the lacrosse head spacer 100 of the present application is inserted between the sidewalls SW of a lacrosse head H, the sidewalls SW should be pushed more than 3 inches apart. The sidewalls SW should be pushed more than 3 inches apart because when the lacrosse head spacer 100 is removed from between the sidewalls SW, the sidewalls SW will tend to recoil or spring back towards each other. Thus, in order to maintain the lacrosse head H in compliance, the spacer 100 must take into account this recoil. Therefore, the width W of the lacrosse head spacer 100 is preferably in the range of about 3.005 inches to about 4.25 inches, more preferably in the range of about 3.125 inches to about 3.875 inches, and most preferably in the range of about 3.375 inches to about 3.75 inches. However, as will be understood by those skilled in the art, the regulations may change. Therefore, the width W of the lacrosse head spacer 100 is preferably in the range of about 1% to about 40% larger than the minimum dimension requirement of lacrosse head regulations, more preferably in the range of about 4% to about 30% larger than the minimum dimension requirement of lacrosse head regulations, and most preferably in the range of about 12% to about 25% larger than the minimum dimension requirement of lacrosse head regulations.

In some embodiments, the lacrosse head spacer 100 may have a height HT preferably in the range of about 1 inch to about 3 inches, more preferably in the range of about 1.5 inches to about 2.5 inches, and most preferably in the range of about 1.75 inches to about 2.25 inches.

Figure 4:
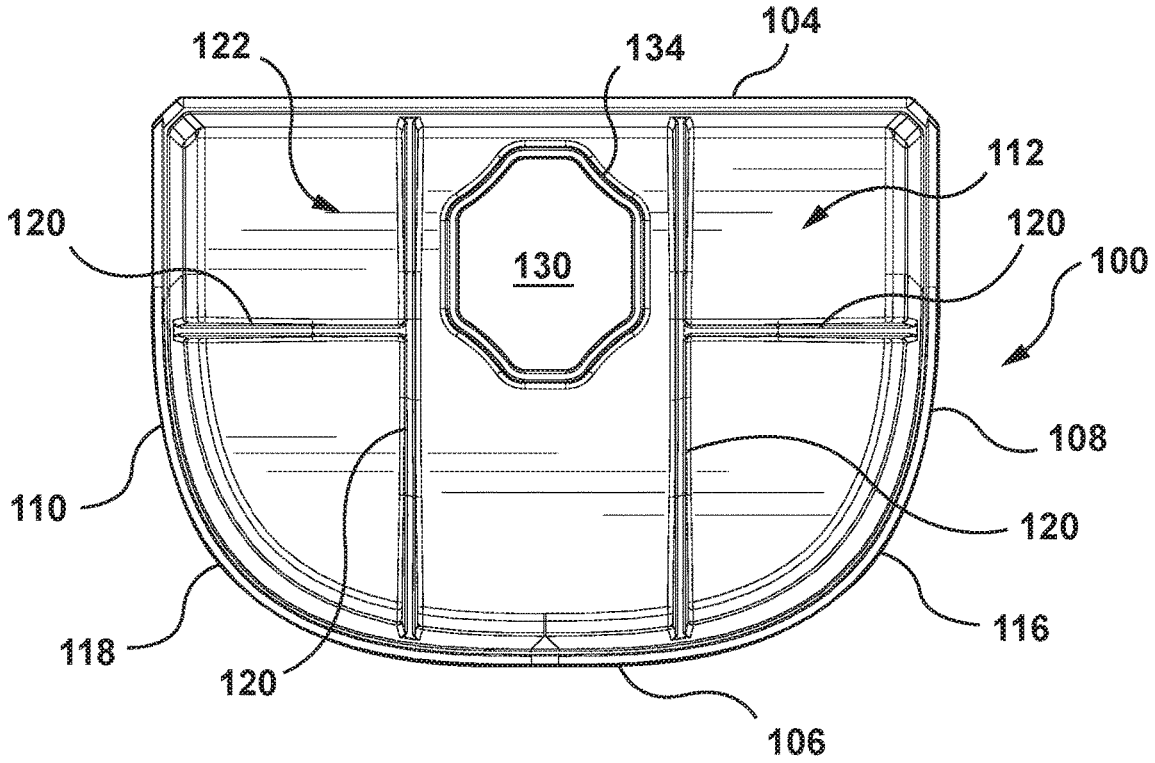
FIG. 4 is a bottom view of the lacrosse head spacer of FIG. 1.
Figure 5:
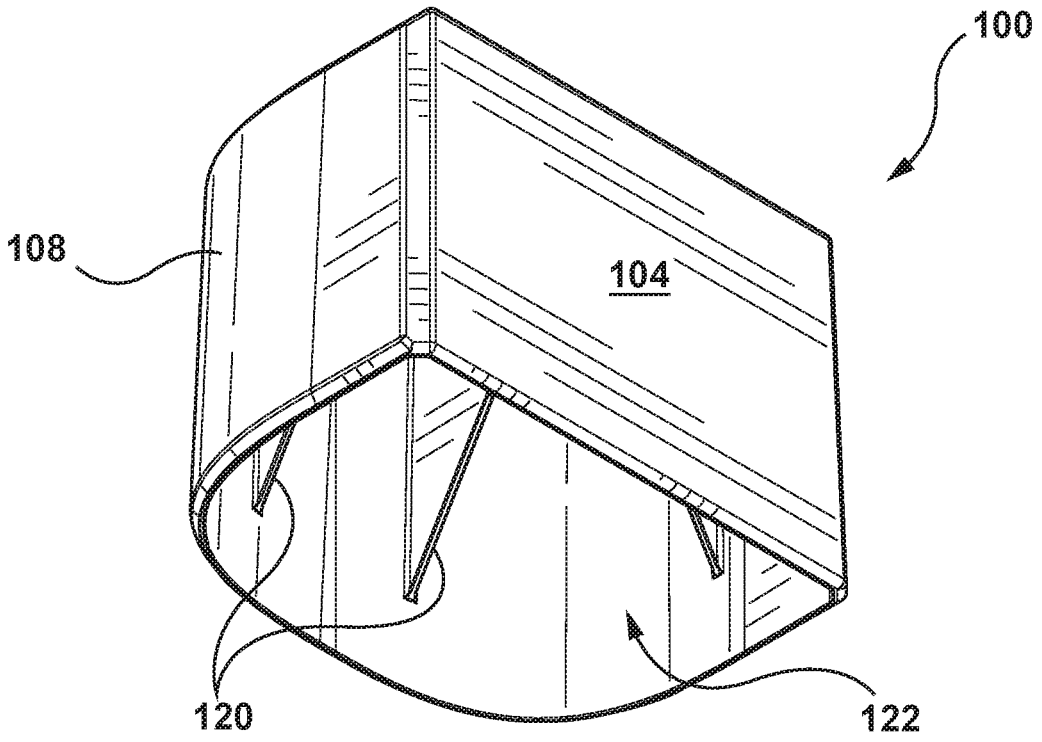
FIG. 5 is a bottom, left perspective view of the lacrosse head spacer of FIG. 1.
Figure 6:
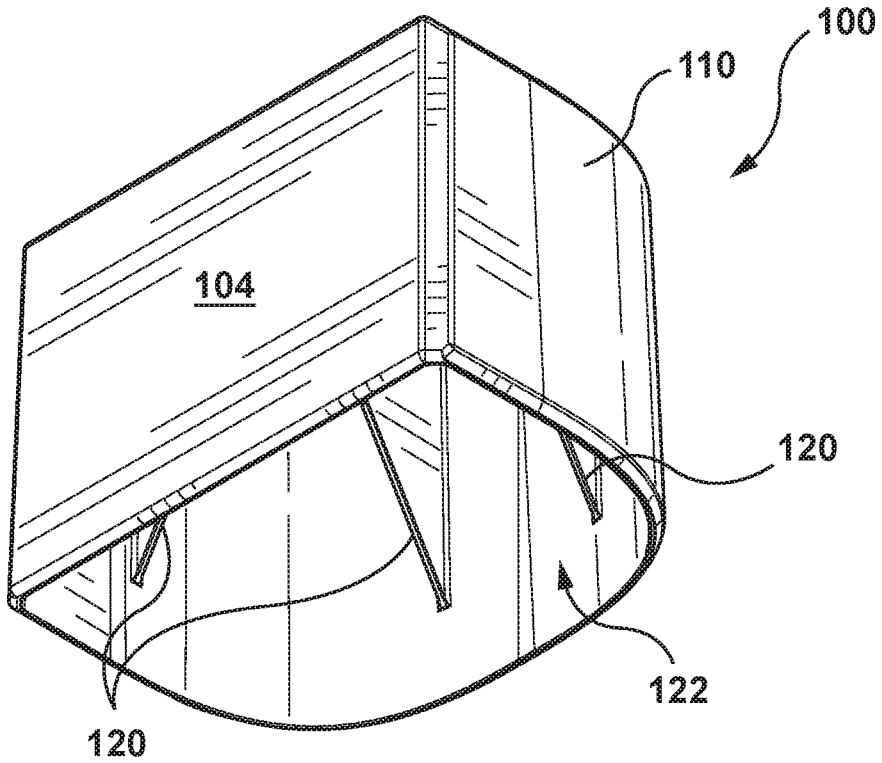
FIG. 6 is bottom, right perspective view of the lacrosse head spacer of FIG. 1.
Figure 7:
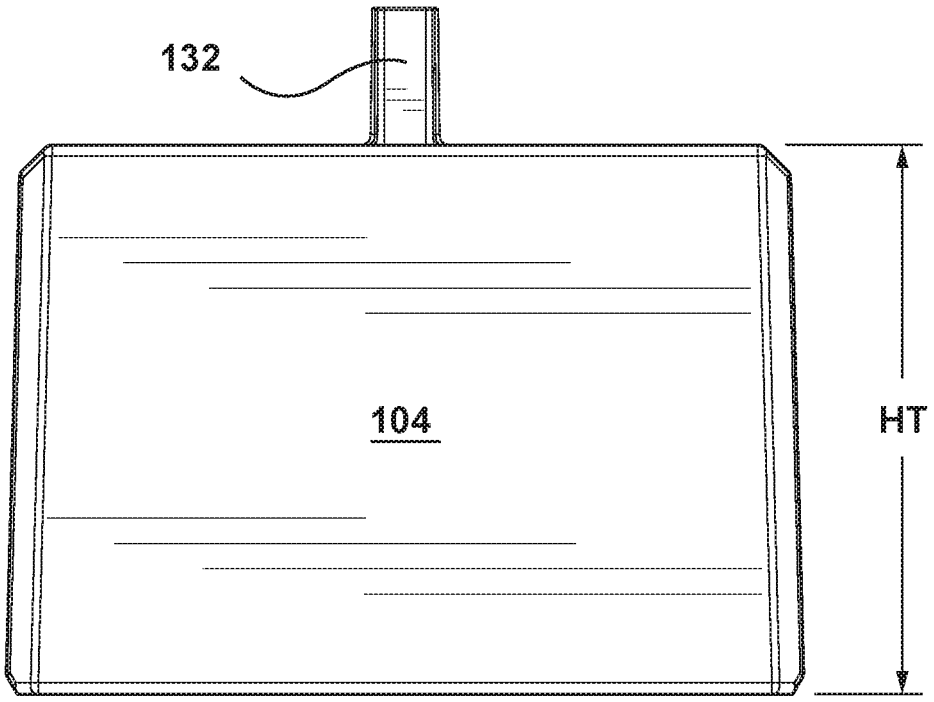
FIG. 7 is front view of the lacrosse head spacer of FIG. 1.
Figure 8:
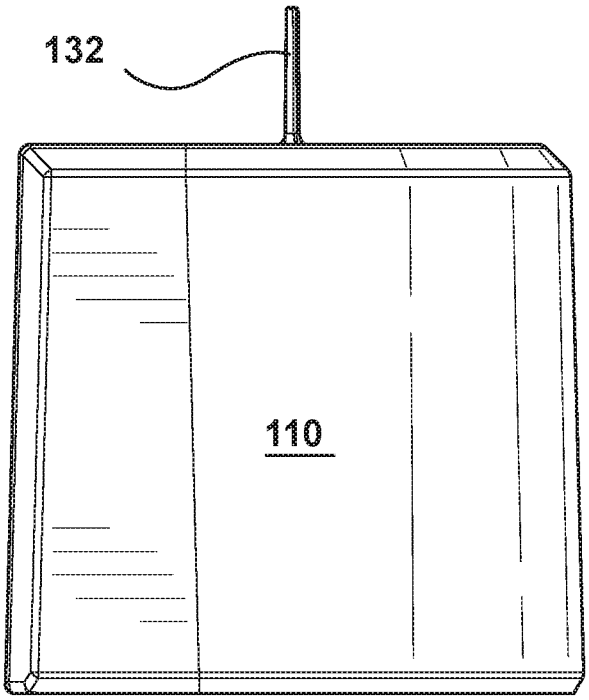
FIG. 8 is a side view of the lacrosse head spacer of FIG. 1.

The spacer 100 may be made of materials such as, but not limited to, thermoplastics (e.g., acrylonitrile butadiene styrene (ABDS), nylon, glass filled nylon, polypropylene, high density polyethylene (HDPE), acrylonitrile butadiene styrene (ABS), polyketone, or sturdy thermoplastics), rubbers, metals (e.g., aluminum), metal alloys (e.g., stainless steel), or other materials suitable for the purposes described herein. The spacer 100, based on its material and construction, must be able to resist against the compression force acting on the left and right side surfaces 108, 110 from the sidewalls SW of a lacrosse head H when placed between the sidewalls SW. Therefore, in some embodiments, the materials and construction of the spacer 100 must be able to resist a compressive force against the left and right side surfaces of at least 4 pounds-force. In the embodiment of FIGS. 1-9, the lacrosse head spacer 100 includes reinforcing ribs 120 in a cavity 122 defined by the surfaces 102, 104, 106, 108, and 110, as best seen in FIGS. 4-6. Reinforcing ribs 120 may be any shape or dimension, and there may be more or fewer than shown. Further, reinforcing ribs 120 may be eliminated if the lacrosse head spacer 100 is made with sufficient strength such that the reinforcing ribs 120 are not needed, either due to material selection or design of the lacrosse head spacer.

The features of the lacrosse head spacer 100 explained above are sufficient for the lacrosse head spacer 100 to be used to maintain lacrosse heads within specified dimensions, as described. The lacrosse head spacer 100 may also be used as a display device and may be sold in conjunction with a particular head. In particular, the front surface 104 and/or other surfaces described herein may include logos, a product name for the lacrosse head spacer and/or the lacrosse head, and other information for point of sale use. In the embodiment shown in FIGS. 1-8, the lacrosse head spacer 100 includes coupling mechanism 128 for coupling the lacrosse head spacer 100 to a lacrosse head such that the lacrosse head spacer 100 may also be used as a display device/stand. In particular, in an embodiment, the coupling mechanism 128 includes an opening 130 and projection or tab 132. The opening 130 extends through the top surface 102 of the lacrosse head spacer 100. The opening 130 is configured to receive an insert or extension of a throat of a lacrosse head, such as the insert of the lacrosse head described in U.S. patent application Ser. No. 16/138,072 filed Sep. 21, 2018, which is incorporated by reference herein in its entirety. The tab 132 extends vertically away from the top surface 102 adjacent the opening 130. The lacrosse head spacer 100 may also include reinforcing ribs 134 extending from the opening 130 downward into the cavity 122.

Figure 10:
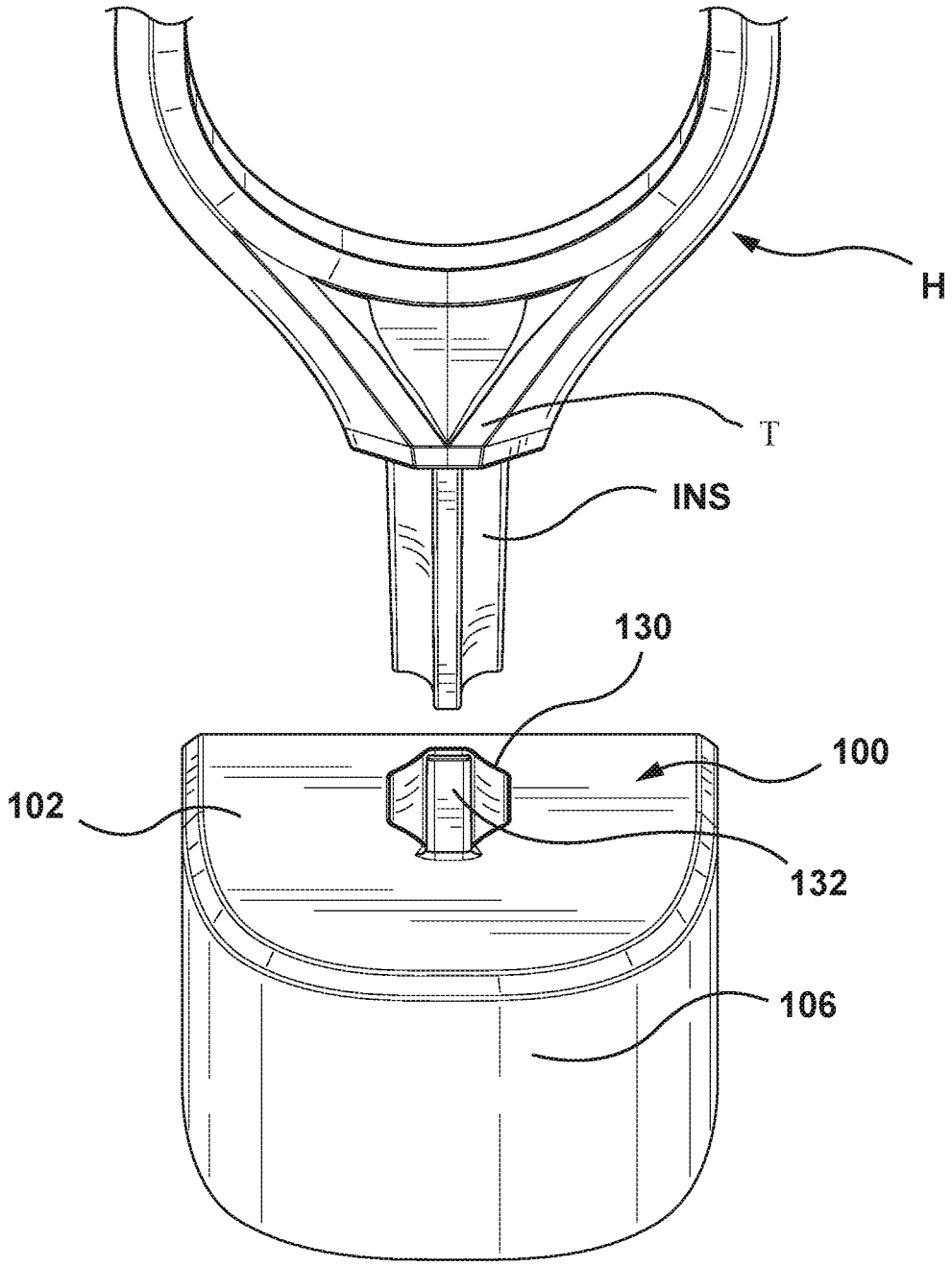
FIG. 10 is an illustration of the lacrosse head spacer of FIG. 1 used for an additional functionality as a display device for a lacrosse head.
Figure 11:
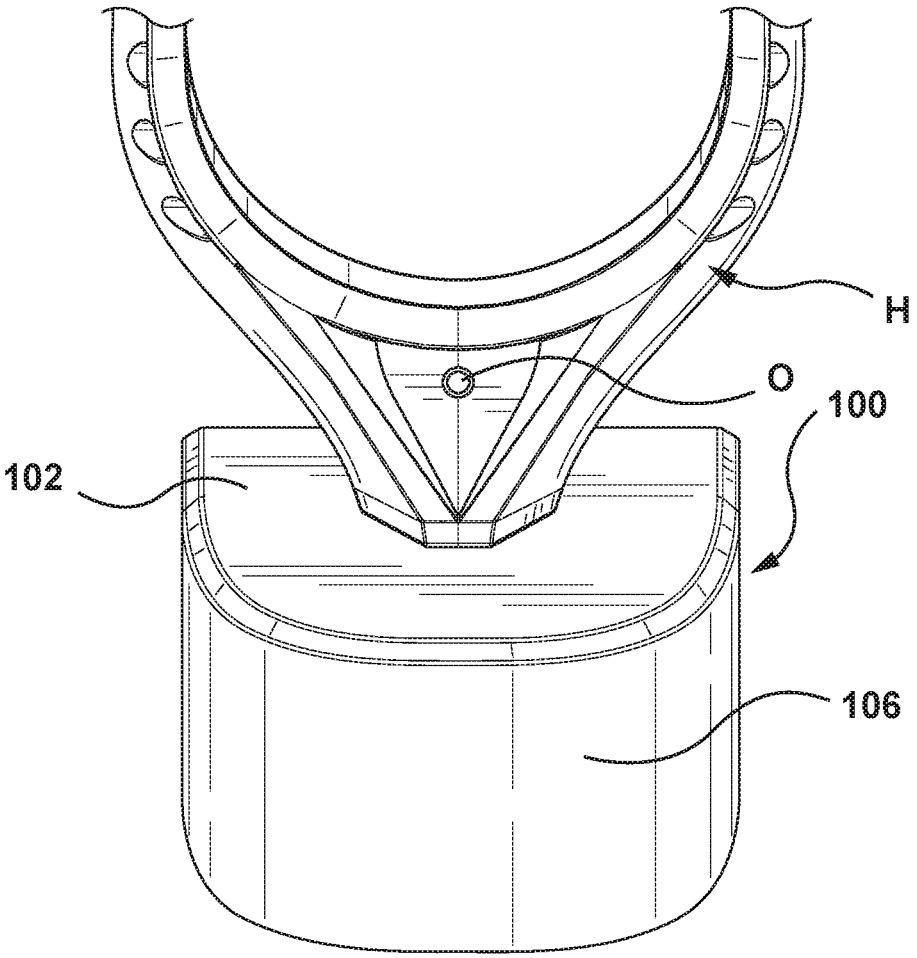
FIG. 11 is another illustration of the lacrosse head spacer of FIG. 1 used as a display device for a lacrosse head.
Figure 12:
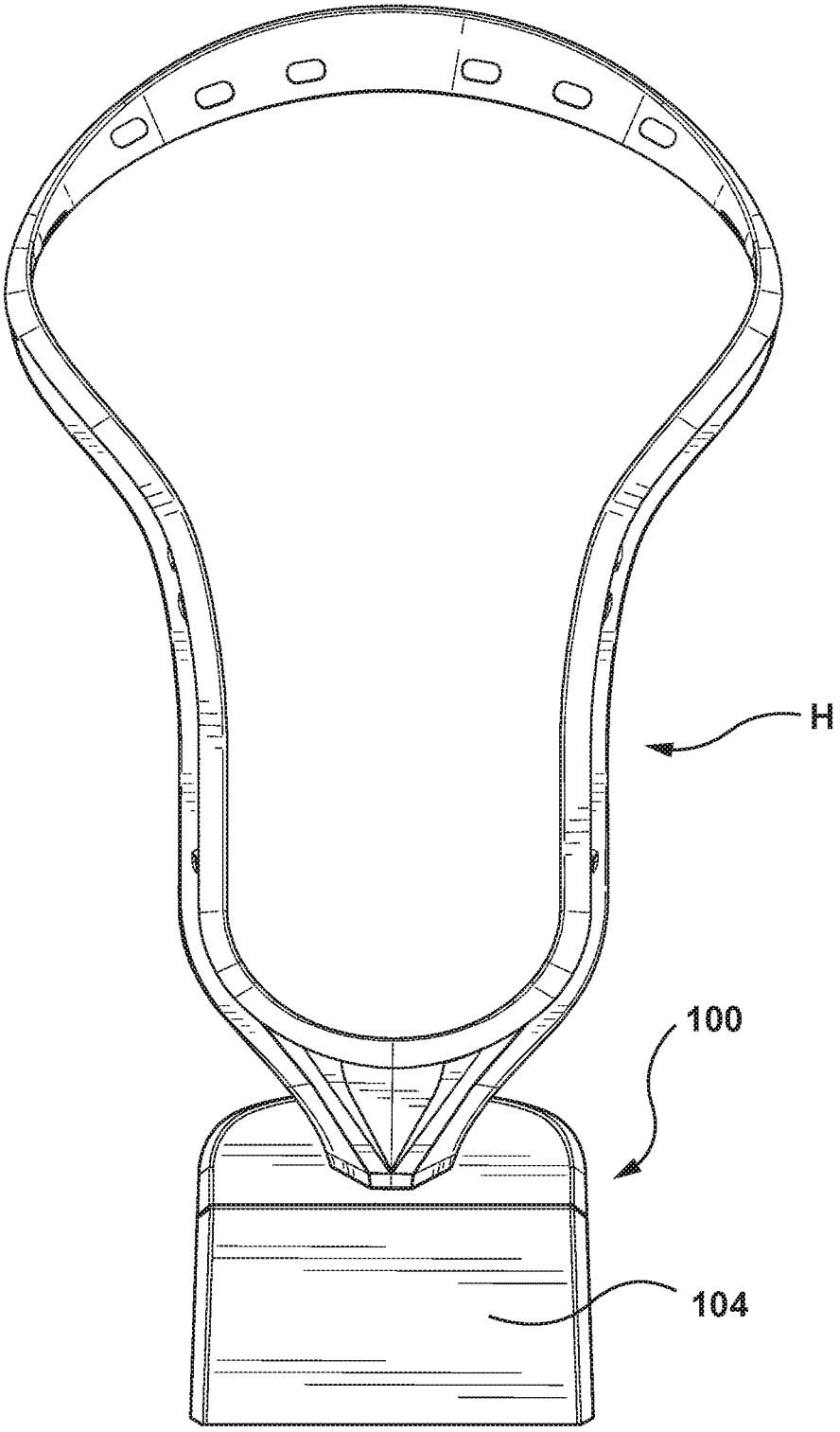
FIG. 12 is another illustration of a lacrosse head connected to the lacrosse head spacer of FIG. 1 for the display functionality.

FIGS. 10-12 show the lacrosse head spacer 100 used for the functionality of a display device. As shown in FIG. 10, a lacrosse head H with an extension or insert INS extending from the throat thereof is aligned with the opening 130 in the lacrosse head spacer 100. In an embodiment, the front of the lacrosse head H faces in the same direction as the front surface 104 of the lacrosse head spacer 100. Further, as can be seen in FIG. 10, the tab 132 is adjacent the opening 130 in the direction of the back surface 106. Thus, as shown in FIG. 11, the insert INS is in front of the tab 132 when inserted into the opening 130, but the throat T of the head H is behind the tab 132. Thus, the tab 132 extends between the insert INS and the throat T of the head H, as shown in FIG. 11. As can be seen in FIG. 11, the tab 132 extends between the insert INS and the throat T such that a portion of the tab 132 is aligned with the attachment opening O of the head H. The attachment opening O of the head H may be for attaching the head H to a lacrosse shaft for use in play, or may be in addition to an opening or openings for attaching the head H to a lacrosse shaft. For use of the lacrosse head spacer 100 as a display device, a screw (not shown) may be inserted through the attachment opening O and screwed into the tab 132 of the lacrosse head spacer 100 to attach the lacrosse head H to the lacrosse head spacer 100. The tab 132 may be relatively thin for ease of screwing the screw into it. Further, the tab 132 is easily breakable from the lacrosse head spacer 100. Thus, after the lacrosse head H and lacrosse head spacer 100 are sold, the lacrosse head H is attached to a lacrosse shaft for play. The tab 132 may be removed from the lacrosse head spacer 100 such that the lacrosse head spacer 100 may be used as a spacer described above. This prevents the tab 132 from snagging on other objects when stored or used. However, removal of the tab 132 is optional.

Figure 13:
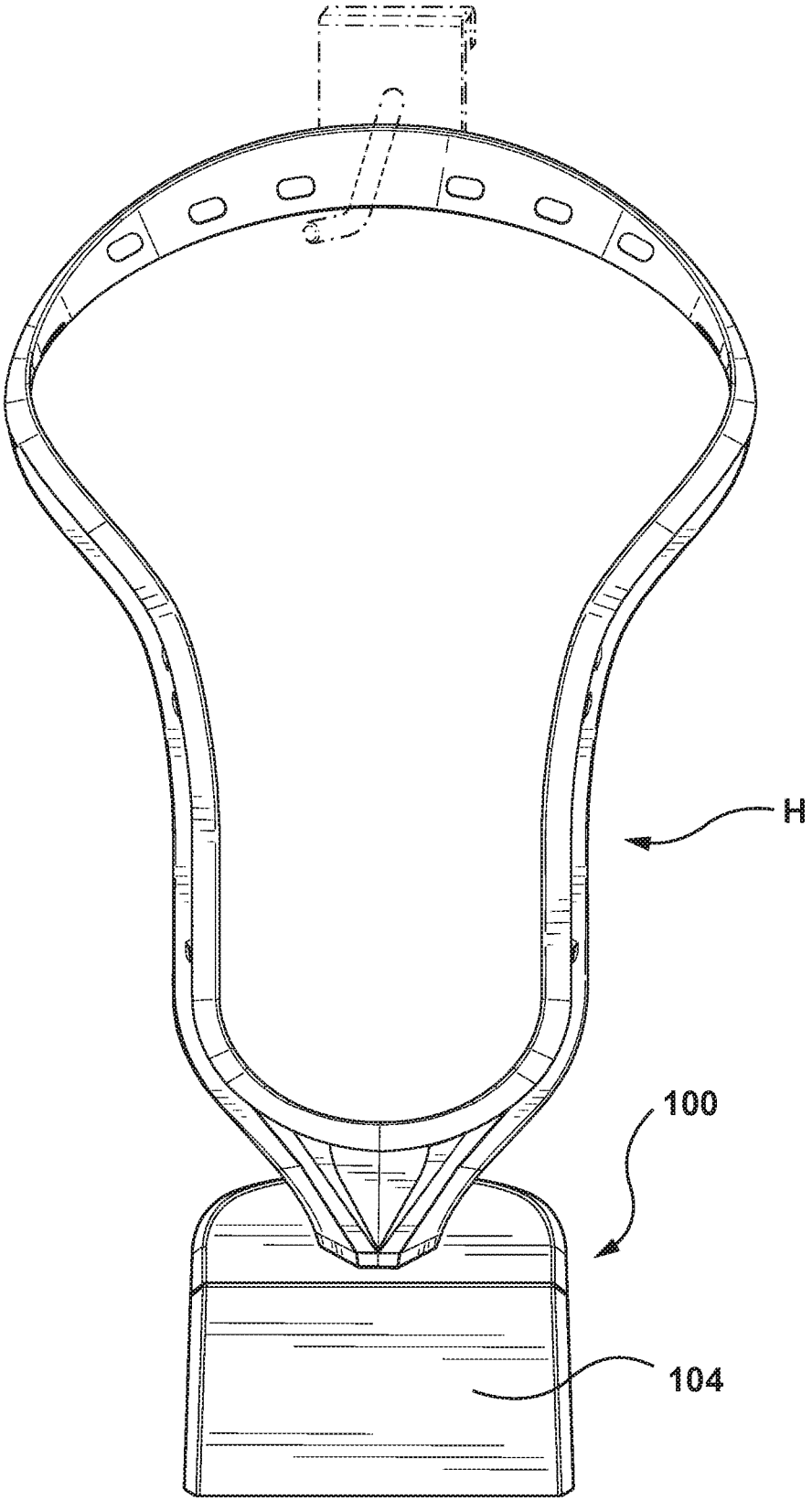
FIG. 13 is an illustration of a lacrosse head connected to the lacrosse head spacer of FIG. 1 and hanging on a display rack.

FIG. 12 shows a front perspective view the lacrosse head spacer 100 attached to the lacrosse head H. As can be seen, the front surface 104, or any other surface, may be used for advertising the product. As shown, in FIG. 12, the lacrosse head spacer 100 may sit on a surface to display the lacrosse head spacer 100 and the lacrosse head H. As shown in FIG. 13, lacrosse heads are often displayed in stores by hanging the heads on a horizontally extending bar that extending through multiple heads such that the inside of the scoop of each head rests on the bar. As can been in FIG. 13, with the lacrosse head spacer 100 attached to the lacrosse head H, the lacrosse head H may be displayed in this manner, with the lacrosse head spacer 100 prominently displayed.

Although a particular coupling mechanism 128 has been shown to attach the lacrosse head spacer 100 to a lacrosse head, i.e. the opening 130 and the tab 132, other structures may be used. For example, some lacrosse heads do not include an insert extending from the throat thereof. Instead, the throat includes an opening that forms a socket for receiving the lacrosse shaft therein. Thus, FIG. 14 shows another embodiment of a lacrosse head spacer 100A. The lacrosse head spacer 100A of FIG. 14 is the same as the lacrosse head spacer 100 of FIGS. 1-13 except that the lacrosse head spacer 100A has a different coupling mechanism 138 for attaching the lacrosse head spacer 100A to a lacrosse head. Thus, all the details of the lacrosse head spacer 100 described above apply to the lacrosse head spacer 100A except the description of the opening 130, the tab 132, and the reinforcing rib 134, and thus need not be repeated. The lacrosse head spacer 100A, instead of the coupling mechanism 128, includes a coupling mechanism 138 including an extension 140 extending upwardly from the top surface 102 thereof, as shown in FIG. 14. In the embodiment shown, the extension 140 is octagonal in cross-sectional shape like a conventional lacrosse shaft. Thus, the extension 140 extends into a socket of a throat of a lacrosse head and is attached to the lacrosse head in a manner similar to a conventional lacrosse head. The cross-sectional size of the extension may be the same or smaller than a conventional lacrosse shaft, as the connection between a lacrosse head and the lacrosse head spacer 100A does not need to be as sturdy as the connection between a lacrosse head and a lacrosse shaft that will be used during play. FIG. 14 partially shows an optional opening 142 through a wall of the extension 142, which may be aligned with an attachment opening in a lacrosse head such that a screw can attach the lacrosse head to the lacrosse head spacer 100A. However, the opening 142 may be eliminated and the screw may extend through the attachment opening of the lacrosse head and an opening may be created in the extension 142 by force of twisting the screw. Further, the extension 140 may be weak enough that it is removable by hand, as described above with respect to the tab 132, or it may be removed with a saw, commonly used for changing lengths of lacrosse shafts. However, as used herein, the term "removable" is limited to tabs or extensions that can be removed by hand, without use of a tool such as a saw.

Figure 15:
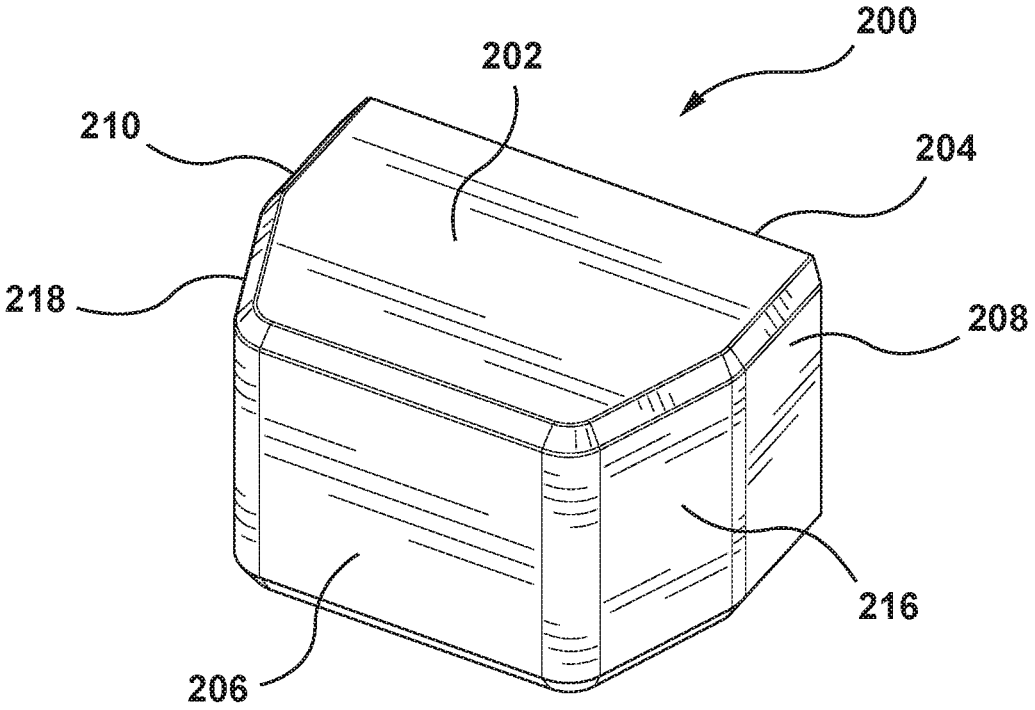
FIG. 15 is a perspective view of a lacrosse head spacer in accordance with another embodiment hereof.
Figure 16:
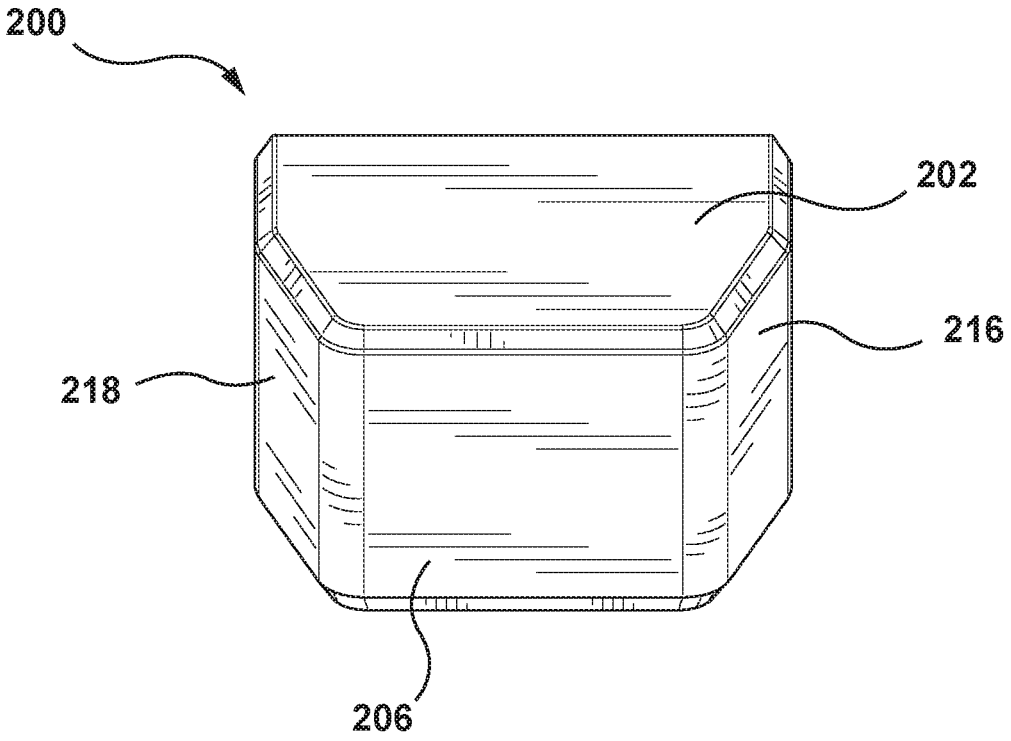
FIG. 16 is a perspective view of the lacrosse head spacer of FIG. 15.
Figure 17:
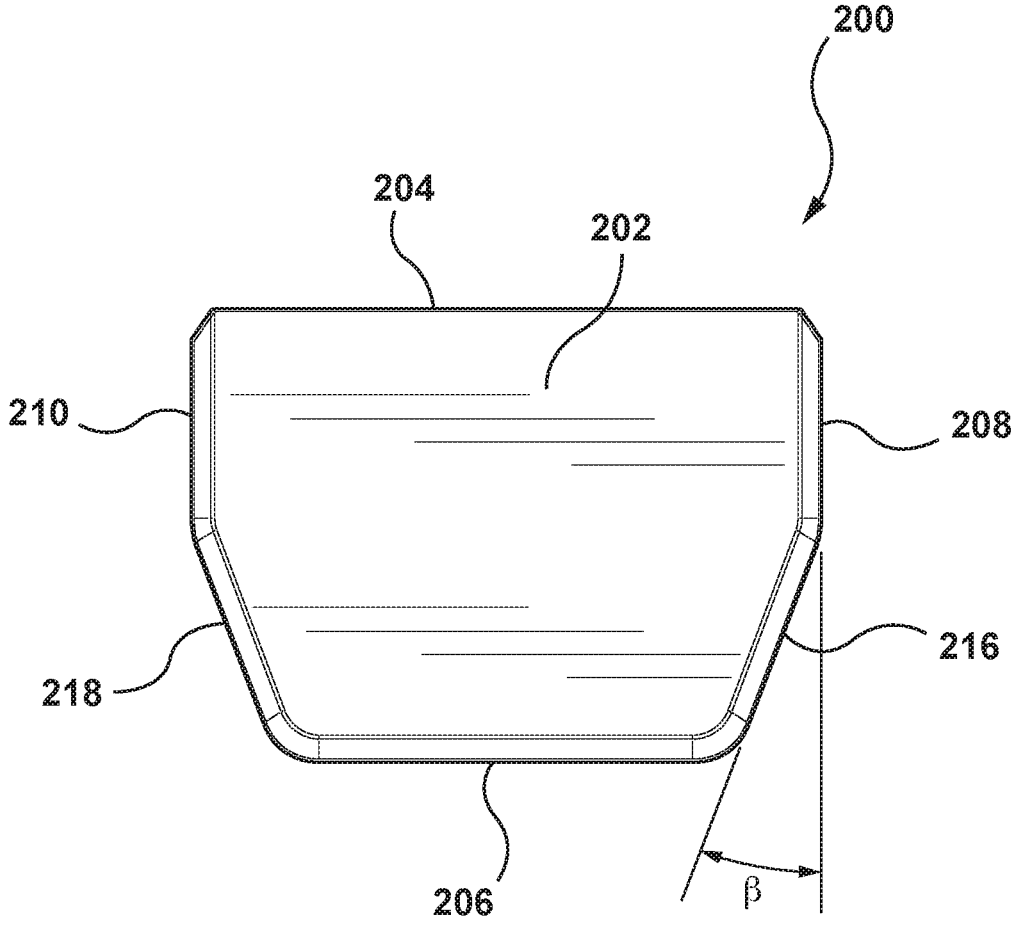
FIG. 17 is a top view of the lacrosse head spacer of FIG. 15.
Figure 18:
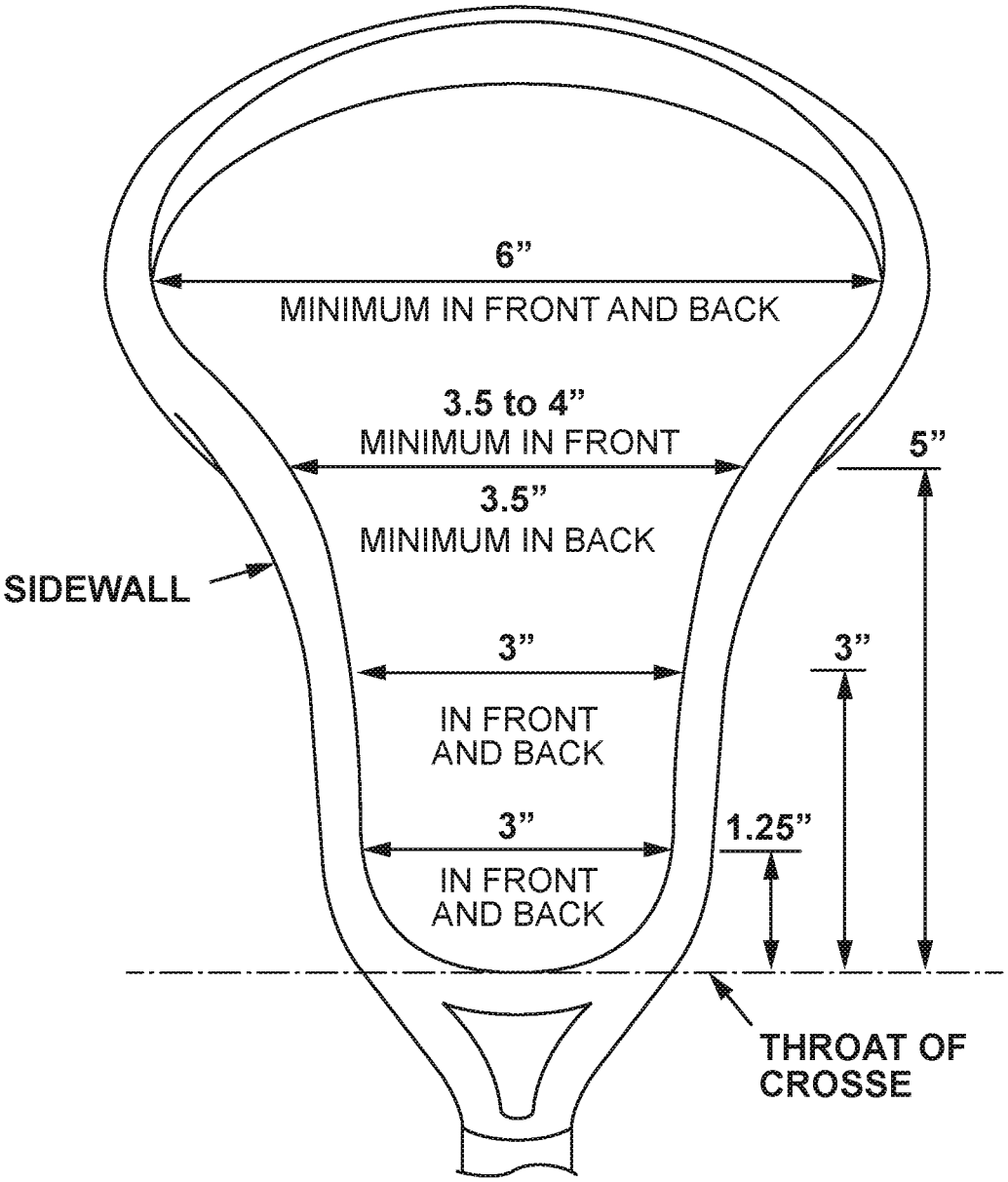
FIG. 18 PRIOR ART
FIG. 18 is a drawing showing current regulations for dimensions of a lacrosse head.

FIGS. 15-17 show a lacrosse head spacer 200 according to another embodiment hereof. The lacrosse head spacer 200 is similar to the lacrosse head 100 described above except that instead of curves 116, 118, the lacrosse head spacer 200 includes a first flat, angled surface 216 between a left side surface 208 and a back surface 206, and a second flat, angled surface 218 between a right side surface 210 and the back surface 206. An angle β between the left side surface 208 and the first angled surface 216, and between the right side surface 210 and the second angled surface 218, may be about 25 degrees. However, the angle β may be in the range of about 5 to about 85. The angled surfaces 216, 218 are angled inwardly such that a width of the back surface measured perpendicularly from where the first angled surface 216 meets the back surface 206 to where the second angled surface 218 meets the back surface is less than the a width measured perpendicularly from the left side surface 208 to the right side surface 210. Similar to the lacrosse head spacer 100, the lacrosse head spacer 200 includes a top surface 202, a front surface 204, the back surface 206, the left side surface 208, the right side surface 210, and a bottom (not shown, and which can be open or closed). As with the lacrosse head spacer 100, it is understood that the terms "top", "bottom", "front", "back", "left", and "right" are relative and depend on the orientation of the of the lacrosse head spacer 200, and therefore are not limiting. Thus, the terms are interchangeable and other terms such as "first", "second" "third", "fourth", etc. instead may be used to describe the surfaces. In this particular embodiment, the front surface 204 is labeled as a front surface because, as described above, the front surface 204 may be used for advertising at the point of sale of lacrosse head sold in combination with a lacrosse head spacer described herein. Similarly, as described in further detail below, the top surface 202 is labeled as a top because it may be used to secure the lacrosse head spacer 200 to a lacrosse head for display at the point of sale, wherein the lacrosse head hangs from a hook or the lacrosse head spacer 200 sits on a horizontal surface such that the top surface 202 would be located vertically above the bottom.

Other than the differences noted above, the lacrosse head spacer 200 includes the same features as described above with respect to the lacrosse head spacer 100 and the lacrosse head spacer 100A. Therefore, the details are not repeated with respect to the lacrosse head spacer 200. For example, and not by way of limitation, the dimensions and materials described above with respect to the lacrosse head spacer 100 apply equally to the lacrosse head spacer 200. Further, and also not by way of limitation, the lacrosse head spacer 200 may include a coupling mechanism (not shown) such as the coupling mechanism 128 shown in FIGS. 1-9 or the coupling mechanism 138 shown in FIG. 14.

While various embodiments according to the present invention have been described above, it should be understood that they have been presented by way of illustration and example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. A lacrosse head and spacer combination comprising:
a lacrosse head including a throat, sidewalls, and a scoop opposite the throat; and
a lacrosse head spacer including:
a first flat surface;
a second surface and a third surface attached at opposing first and second edges of the first flat surface;
a curved surface extending between the second surface and the third surface, wherein the curved surface is disposed opposite the first flat surface, and
a coupling mechanism for coupling the lacrosse head spacer to the lacrosse head,
wherein a width of the lacrosse head spacer measured perpendicularly from the second surface to the third surface is in a range of about 3.005 to about 4.25 inches,
wherein the lacrosse head spacer is configured to be inserted between the sidewalls of the lacrosse head with the curved surface facing the throat of the lacrosse head and the first flat surface facing the scoop of the lacrosse head to maintain the sidewalls of the lacrosse head spaced apart a distance in a range of about 3.005 inches to about 4.25 inches when the lacrosse head spacer is inserted between the sidewalls of the lacrosse head.

2. The lacrosse head and spacer combination of claim 1, wherein the width is in the range of about 3.125 inches to about 3.875 inches such that the lacrosse head spacer is configured to maintain the sidewalls of the lacrosse head spaced apart in a range of about 3.125 inches to about 3.875 inches when the lacrosse head spacer is inserted between the sidewalls of the lacrosse head.

3. The lacrosse head and spacer combination of claim 1, wherein the width is in the range of about 3.375 inches to about 3.75 inches such that the lacrosse head spacer is configured to maintain the sidewalls of the lacrosse head spaced apart in a range of about 3.375 inches to about 3.75 inches when the lacrosse head spacer is inserted between the sidewalls of the lacrosse head.

4. The lacrosse head and spacer combination of claim 1, further comprising a fourth surface extending perpendicular to the first surface, the second surface, the third surface, and the curved surface, wherein the fourth surface is attached to an edge of each of the second surface, the third surface, and the curved surface.

5. The lacrosse head and spacer combination of claim 4, wherein the first flat surface is a front surface, the second surface is a left side surface, the third surface is a right side surface, the curved surface is a back surface, the fourth surface is a top surface, and the edge of each of the first, second, third, and curved surfaces is a top edge.

6. The lacrosse head and spacer combination of claim 1, wherein a height of the lacrosse head spacer measured perpendicular to the width is in the range of 1 inch to 3 inches.

7. The lacrosse head and spacer combination of claim 1, wherein a height of the lacrosse head spacer measured perpendicular to the width is in the range of 1.5 inches to 2.5 inches.

8. The lacrosse head and spacer combination of claim 1, wherein a height of the lacrosse head spacer measured perpendicular to the width is in the range of 1.75 inches to 2.25 inches.

9. The lacrosse head and spacer combination of claim 1, wherein the coupling mechanism comprises an opening through a top surface of the lacrosse head spacer, wherein the opening is configured to receive an insert extending from the throat of the lacrosse head.

10. The lacrosse head and spacer combination of claim 9, wherein the coupling mechanism further comprises a tab extending from the top surface and disposed adjacent to the opening, wherein the tab is configured to be attached to the lacrosse head.

11. The lacrosse head of and spacer combination claim 10, wherein the tab is removably coupled to the top surface of the lacrosse head spacer.

12. The lacrosse head and spacer combination of claim 1, wherein the coupling mechanism comprises an extension extending from a top surface of the lacrosse head spacer, wherein the extension is configured to be received in a socket of the throat of a lacrosse head.

13. A lacrosse head spacer comprising:
a first flat surface;
a second surface and a third surface attached at opposing first and second edges of the first flat surface;
a curved surface extending between the second surface and the third surface, wherein the curved surface is disposed opposite the first flat surface; and
a coupling mechanism for coupling the lacrosse head spacer to a lacrosse head,
wherein a width of the lacrosse head spacer measured perpendicularly from the second surface to the third surface is in a range of about 3.005 to about 4.25 inches,
wherein the lacrosse head spacer is configured to be inserted between sidewalls of a lacrosse head with the curved surface facing a throat of the lacrosse head and the first flat surface facing a scoop of the lacrosse head to maintain the sidewalls of the lacrosse head spaced apart a distance in a range of about 3.005 inches to about 4.25 inches when the lacrosse head spacer is inserted between the sidewalls of the lacrosse head.

14. The lacrosse head spacer of claim 13, wherein the coupling mechanism comprises an opening through a top surface of the lacrosse head spacer, wherein the opening is configured to receive an insert extending from a throat of the lacrosse head.

15. The lacrosse head spacer of claim 14, wherein the coupling mechanism further comprises a tab extending from the top surface and disposed adjacent to the opening, wherein the tab is configured to be attached to the lacrosse head.

16. The lacrosse head of spacer claim 15, wherein the tab is removably coupled to the top surface of the lacrosse head spacer.

17. The lacrosse head spacer of claim 13, wherein the coupling mechanism comprises an extension extending from a top surface of the lacrosse head spacer, wherein the extension is configured to be received in a socket of a throat of a lacrosse head.

18. A lacrosse head and spacer combination comprising:
a lacrosse head including a throat; sidewalls, and a scoop opposite the throat; and
a lacrosse head spacer including:
a flat front surface,
a left side surface attached at a left edge of the flat front surface,
a right side surface attached at right edge of the flat front surface,
a curved back surface extending between the left side surface and the right side surface, wherein the curved back surface is disposed opposite the flat front surface, and a coupling mechanism for coupling the lacrosse head spacer to the lacrosse head, wherein a width of the lacrosse head spacer measured perpendicularly from the left side surface to the right side surface is in a range of about 1% to about 40% larger than a minimum width dimension specified by NCAA rules for lacrosse heads, wherein the lacrosse head spacer is configured to be inserted between the sidewalls of the lacrosse head with the curved back surface facing the throat of the lacrosse head and the flat front surface facing the scoop of the lacrosse head to maintain the sidewalls of the lacrosse head spaced apart a distance in a range of about 1% to about 40% larger than a minimum width dimension specified by NCAA rules for lacrosse heads when the lacrosse head spacer is inserted between the sidewalls of the lacrosse head.

19. The lacrosse head and spacer combination of claim 18, wherein the width is in the range of about 4% to about 30% larger than a minimum width dimension specified by NCAA rules for lacrosse heads such that the lacrosse head spacer is configured to maintain the sidewalls of the lacrosse head spaced apart in a range of about 4% to about 30% larger than the minimum width dimension specified by NCAA rules for lacrosse heads when the lacrosse head spacer is inserted between the sidewalls of the lacrosse head.

20. The lacrosse head and spacer combination of claim 18, wherein the width is in the range of about 12% to about 25% larger than the minimum width dimension specified by NCAA rules for lacrosse heads such that the lacrosse head spacer is configured to maintain the sidewalls of the lacrosse head spaced apart in a range of about 12% to about 25% larger than the minimum width dimension specified by NCAA rules for lacrosse heads when the lacrosse head spacer is inserted between the sidewalls of the lacrosse head.

21. The lacrosse head and spacer combination of claim 18, further comprising a top surface extending perpendicular to the flat front surface, the left side surface, the right side surface, and the curved back surface, wherein the top surface is attached to a top edge of each of the flat front surface, the left side surface, the right side surface, and the curved back surface.

22. The lacrosse head and spacer combination of claim 18, wherein the coupling mechanism comprises an opening through a top surface of the lacrosse head spacer, wherein the opening is configured to receive an insert extending from the throat of the lacrosse head.

23. The lacrosse head and spacer combination of claim 22, wherein the coupling mechanism further comprises a tab extending from the top surface and disposed adjacent to the opening, wherein the tab is configured to be attached to the lacrosse head.

24. The lacrosse head of and spacer combination claim 23, wherein the tab is removably coupled to the top surface of the lacrosse head spacer.

25. The lacrosse head and spacer combination of claim 18, wherein the coupling mechanism comprises an extension extending from a top surface of the lacrosse head spacer, wherein the extension is configured to be received in a socket of the throat of a lacrosse head.

26. The lacrosse head and spacer combination of claim 18, Wherein a height of the lacrosse head spacer measured perpendicular to the width is in the range of 1 inch to 3 inches.

27. The lacrosse head and spacer combination a claim 18, wherein a height of the lacrosse head spacer measured perpendicular to the width is in the range of 1.5 inches to 2.5 inches.

28. The lacrosse head and spacer combination of claim 18, wherein a height of the lacrosse head spacer measured perpendicular to the width is in the range of 1.75 inches to 2.25 inches.

* * * * *